United States Patent [19]

Schmidt

[11] 4,216,560

[45] Aug. 12, 1980

[54] DEBURRING APPARATUS

[76] Inventor: Rainer Schmidt, Rosmart 30, 5990 Altena 4, Fed. Rep. of Germany

[21] Appl. No.: 910,702

[22] Filed: May 30, 1978

[30] Foreign Application Priority Data

Jun. 4, 1977 [DE] Fed. Rep. of Germany ... 7717764[U]
Jul. 28, 1977 [DE] Fed. Rep. of Germany ... 7723581[U]

[51] Int. Cl.[3] ..... A46B 13/02

[52] U.S. Cl. ..... 15/21 D; 15/268; 51/98 R; 51/238 R

[58] Field of Search ..... 15/21 D, 268; 51/98 R, 51/125, 219 R, 238 R

[56] References Cited

U.S. PATENT DOCUMENTS

| | | | |
|---|---|---|---|
| 1,282,022 | 10/1918 | Baker et al. | 51/98 R |
| 2,401,471 | 6/1946 | Fendring | 51/219 R |
| 2,486,335 | 10/1949 | Smith et al. | 51/219 R |
| 4,142,332 | 3/1979 | Clarke | 51/219 R X |

*Primary Examiner*—Edward L. Roberts
*Attorney, Agent, or Firm*—Allison C. Collard; Thomas M. Galgano

[57] ABSTRACT

An apparatus for deburring workpieces such as profiles, tubes, metal sheets or the like, is provided which includes a housing and a deburring tool rotatably mounted within the housing about a horizontal axis such that the tool partially projects from the housing. A workpiece holder is located in front of the housing for holding the workpiece to be deburred level with and in abutment with the rotatable tool. The holder has a block portion, which is a workpiece retaining device. The block portion and the workpiece receiving device are displaceable into the housing in a direction towards the tool.

3 Claims, 5 Drawing Figures

DEBURRING APPARATUS

The present invention relates to a deburring apparatus for removing burrs from profiles, tubes or sheets.

Known deburring apparatuses have a housing accommodating a deburring tool rotating about a horizontal axis. In front of this housing a holder is provided to support the workpiece to be deburred. The tool partially projects from the housing. The workpiece is supported level with and spaced from the tool. The tool is generally a grinding wheel or a brush wheel.

In such devices, it is difficult to ensure that the spacing between the workpiece support and the rotating tool is maintained constant, so that the workpiece is not pulled towards or into the housing.

In such known apparatuses, after a certain time period of use, the outer diameter of the deburring tool becomes reduced due to wear. Resetting the tool holder in such known devices is complex and the amount of adjustment is usually minimal. Moreover, adjustment is no longer possible when the tool holder is located directly in front of the housing. A further disadvantageous feature of such known devices is that the rotating tool is laterally unguarded and is a potential source of accidents.

To deburr metal sheets, an apparatus is known in which the sheet is conducted along a passage rail in a machine housing. Rotory grinding or cutting tools are brought into contact from below with the edge of the sheet to be deburred. In many cases a new burr is formed by such action.

The present invention seeks to provide a relatively simple apparatus for deburring workpieces such as profiles, tubes or metal sheets in which a simple adjustment of the workpiece holder relative to the rotating tool is possible. Furthermore, the invention seeks to provide an apparatus which can be suitably guarded and in which the maximum available thickness of the tool effecting the deburring can be used.

In accordance with the present invention, there is provided an apparatus for deburring workpieces such as profiles, tubes or metal sheets comprising a housing capable of accommodating a deburring tool rotatable about a horizontal axis such that the tool partially projects from the housing, a workpiece holder located in front of the housing for holding the workpiece to be deburred level with and in abutment with the rotatable tool, the holder comprising a block portion provided with workpiece retaining means-namely at least one workpiece holder adapted to the shape of the workpiece to be deburred, which block and holder or holders are insertable into the housing in a direction towards the rotating tool.

Alternatively or additionally, the tool may be mounted so as to be displaceable horizontally towards the workpiece holder. Thus, in the case of a metal sheet to be deburred, the rotating tool, which is preferably a wire wheel, may be used over substantially its entire effective diameter. When the tool wears, the workpiece holder which is readily interchangeable, and the rotating tool may be displaced relative to one another.

In a preferred embodiment of the present invention a horizontal bar guide slidable into the housing is provided on the block portion, a support capable of receiving a workpiece holder being mounted on the block portion so as to be displaceable upwardly at an oblique angle to the periphery of the rotatable tool.

On the holder block portion, a vertically adjustable support capable of receiving various tool holders is provided. A support plate of prismatic cross-section may be mounted on this support.

For deburring the end-faces of workpieces, it is desirable if the workpiece holder is in the form of a plate holder extending substantially vertically at right angles to the axis of rotation of the rotating tool, the holder having a horizontally displaceable guard and guide plate which plate has an aperture formed therein through which a workpiece can be passed such that the end face of the workpiece is capable of being deburred.

For deburring metal sheets, it is preferred if the workpiece holder has a support plate pivotable about a horizontal axis and a guard plate extending substantially at right angles thereto, the guard plate being provided with a substantially rectangular aperture therein through which the rotatable tool, which is displaceable in a direction towards the holder, acts on the edge of the workpiece to be deburred.

Advantageously, the support plate is of substantially U-shaped cross-section, one of the shanks of the U having an elongate recessed slot formed therein which is concentric with the pivot axis retaining means being provided which pass through this slot and which retains the support plate at a desired angle of inclination with respect to the workpiece holder.

The combination of a rotary brush or brush wheel being displaceable towards the workpiece holder together with the adjustment of the inclination of support plate permits a reliable radiusing of the edge of the sheet to be deburred.

The invention will be further described, by way of example, with reference to the accompanying drawings, in which.

Figure 1:
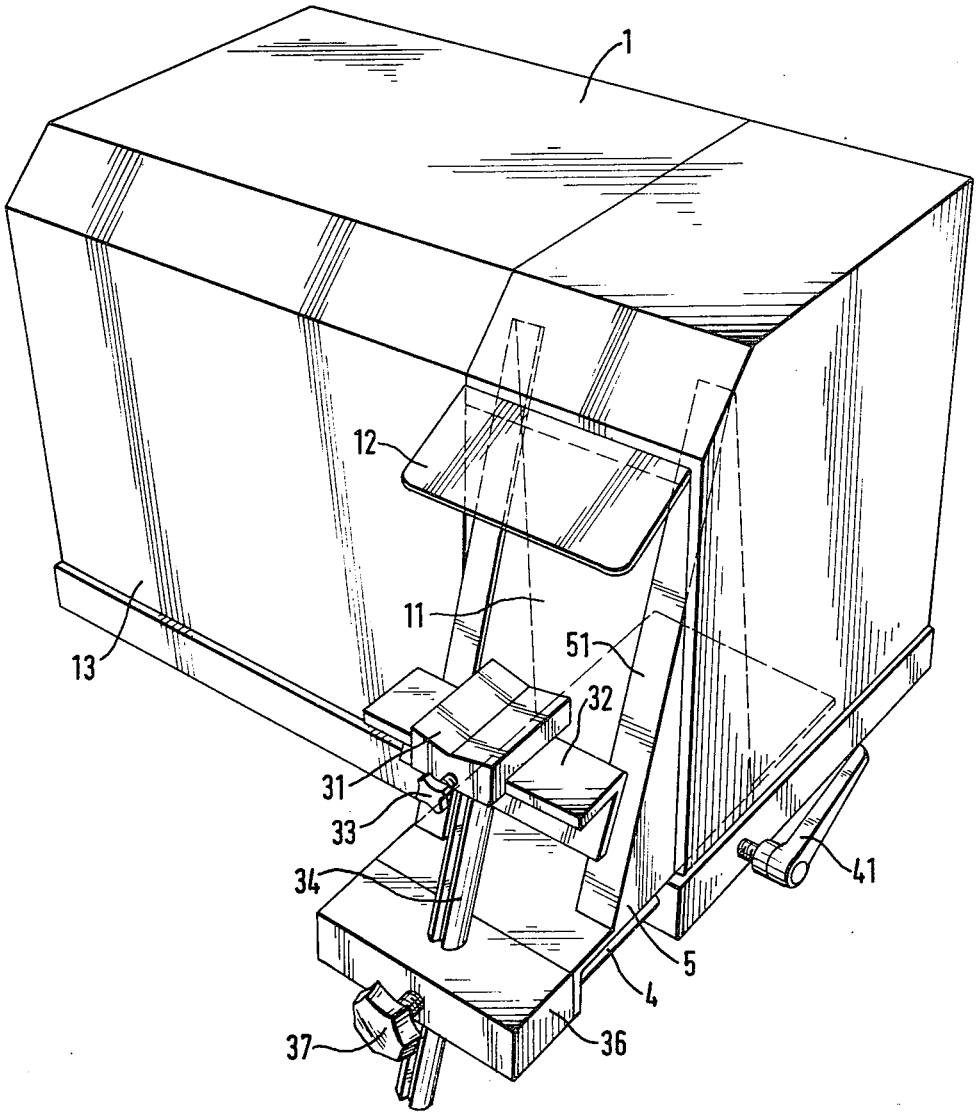
FIG. 1 is a perspective view of an apparatus in accordance with the present invention, the rotary deburring tool having been omitted for the sake of clarity.
Figure 3:
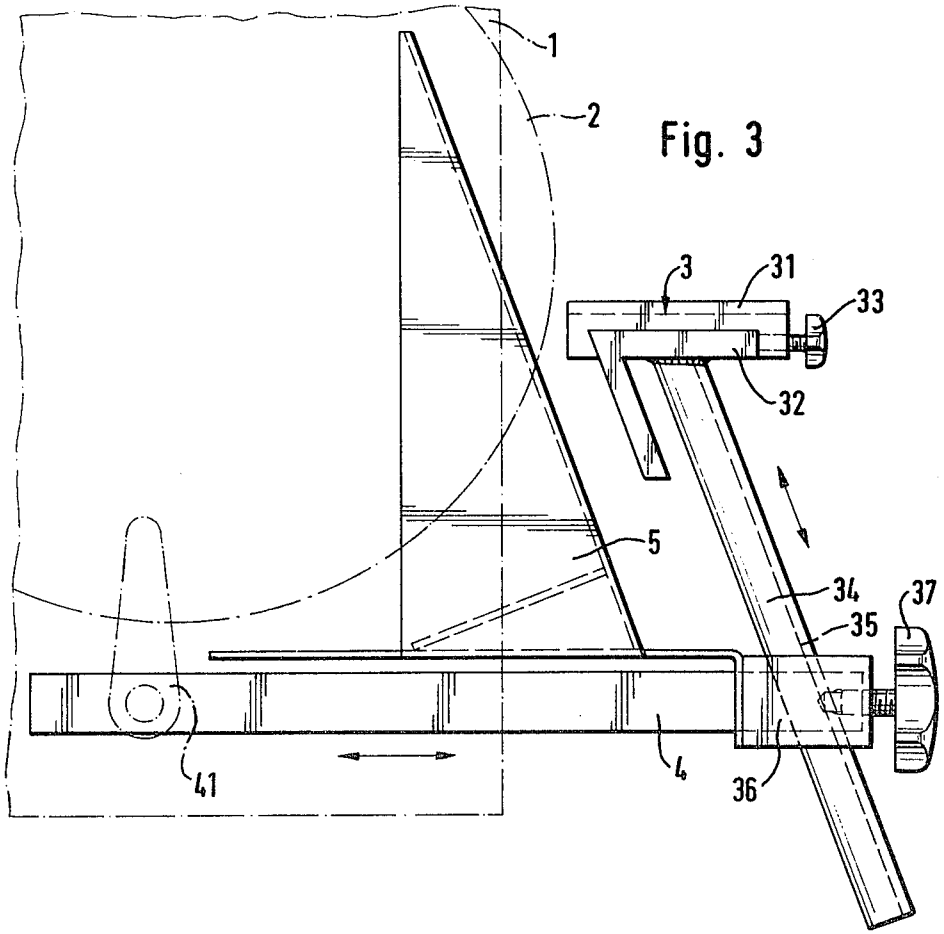
FIG. 3 is a side view of the apparatus shown in FIG. 1 but also shows part of the deburring tool.
Figure 2:
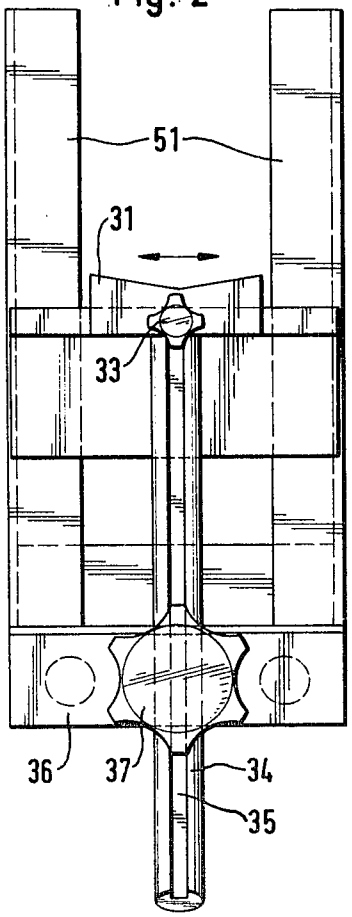
FIG. 2 is a plan view of a workpiece holder having a prismatic supporting plate, the holder forming part of an apparatus of the present invention.

Referring firstly to FIGS. 1 to 3, there is shown a machine housing 1 having an aperture 11 formed in the front wall 13 thereof. Within the housing, drive means and bearings for a drive shaft are provided, the shaft projecting through the aperture 11 and carrying, at its free end, a grinding tool in the form of a brush wheel 2 (FIG. 3). A cover plate 12 is provided on the housing above the brush wheel 2.

Below the brush wheel 2, a workpiece holder block 36 having lateral guard plates 5, which block is insertable into the housing 1 is mounted on a bar guide 4. Further guides may also be provided. The lateral guard plates 5 are triangular and, in use, have one apex directed upwardly. Each plate has a leading edge face 51 which is directed into the housing and which may have markings thereon. The displaceable bar guide 4 is secured in its desired position by a lateral securing lever 41.

A tube 34 provided with a leading groove 35 is mounted in the workpiece holder block 36 so as to pass obliquely therethrough. The tube is longitudinally displaceable towards the tool 2, and may be secured or fixed at any desired level by means of a clamping screw 37. On the upper end of the tube 34, a horizontal support 32 is provided which is capable of receiving a variety of workpiece holders. The workpiece holder generally denoted by the reference numeral 3 in FIG. 3, accommodates a laterally displaceable, prismatic support plate 31 which is held thereon by means of clamping screw 33.

When the block 36 and its bar guide 4 are horizontally displaced, the lateral guard plates 5 are also displaced and the amount they project through the aperture 11 of the housing depends upon the position of the guide 4.

Figure 4:
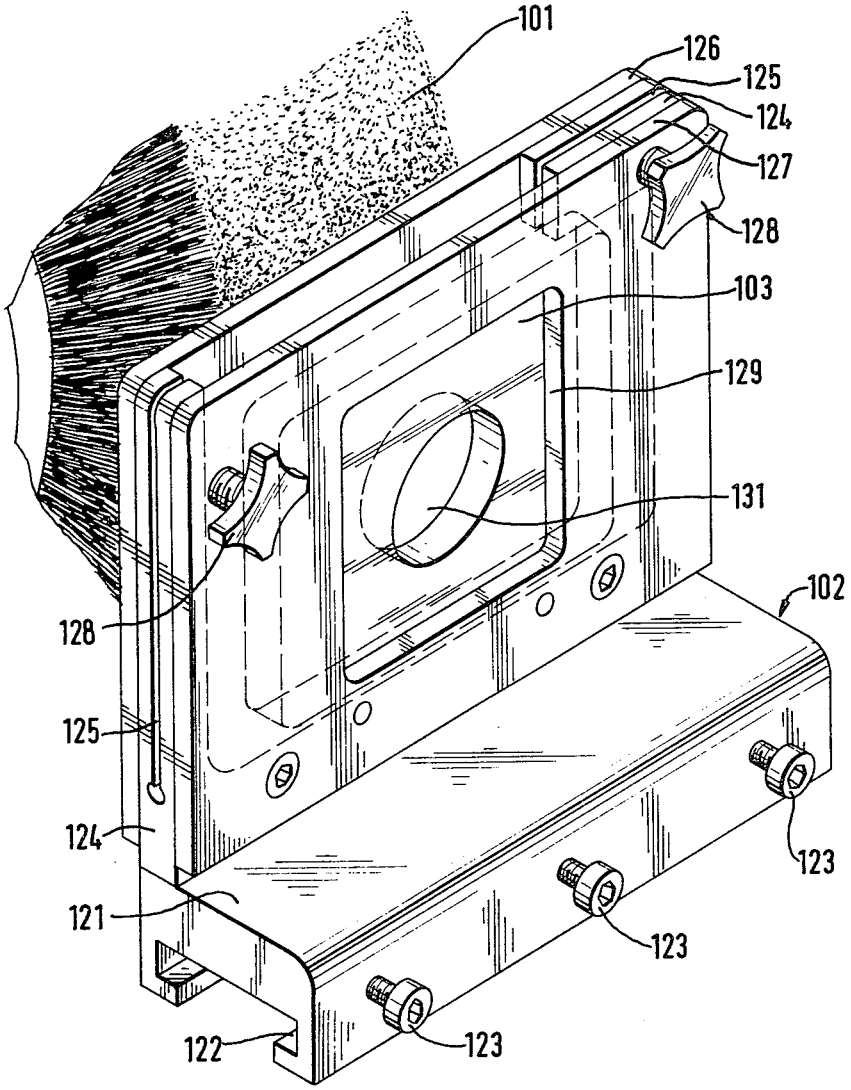
FIG. 4 is a perspective view of a workpiece holder suitable for effecting end-on deburring of tubes or other suitable profiles, the rotary tool being a brush wheel.

The apparatus shown in FIG. 4 is mounted on a corresponding support on a holder block as shown in FIGS. 1 to 3. A workpiece holder 102 in the form of a plate holder, is similarly adjustable so as to be located level with, but spaced from the rotating brush 101. In the base 121 of the holder, a dovetailed groove 122 is provided, by means of which the base of the holder can be positively located on the support. Securing of the holder on the base is effected by means of clamping screws 123.

Extending substantially vertically upwards from the holder base 121 are two spaced-apart centrally apertured clamping plates 126 and 127. These plates can be displaced towards and away from one another. Between these plates a guard and guide plate 103 may be inserted from above. The central apertures of the plates are referenced 129. The plates are retained in position by two resilient strap webs 124 extending vertically from the holder base 121. Each web is slotted at 125. A workpiece guide in the form of a plate 103 is inserted between the two plates 126 and 127 which latter plates are drawn together by means of two grip screws 128. By slackening the grip screws 128, the plate 103 can be laterally displaced to ensure uniform wearing of the brush 101. The plate 103 is provided with a central aperture 131 through which the workpiece to be deburred is moved towards the brush 101. This aperture 131 in the interchangeable plates 103 is shaped in conformity with the configuration and external dimensions of the workpiece to be deburred to ensure that an operator of the apparatus cannot pass his hand between the workpiece and the wall of the aperture.

Figure 5:
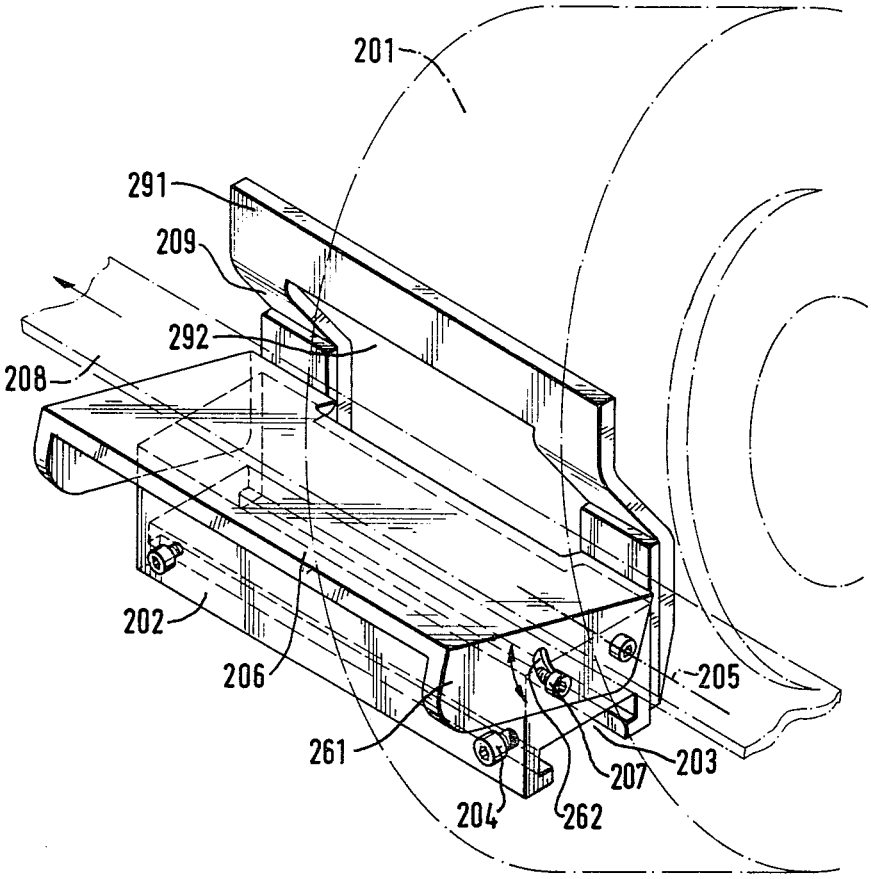
FIG. 5 is a perspective view of a further workpiece holder capable of receiving metal sheets to be deburred.

In FIG. 5, there is shown an apparatus for deburring metal sheets in which the rotating brush 201 is horizontally adjustable. In this apparatus, the metal sheet 208 to be deburred in drawn across the periphery of the brush in front of the housing, not shown. The workpiece holder is designated 202 and has a base which is again mounted on and secured to a support by means of a dovetailed groove 203. Securing screws 204 are provided for securing the base to the support. The support plate 206 of the holder 202 is of U-shaped cross-section and is pivotable about a horizontal axis 205. The support plate is mounted on the base. An edge of the metal sheet 208 to be treated is located on the support plate.

To secure the plate 206 in an inclined position one of the shanks 261 of the U has an elongate recess 262 formed therein which is concentric with the axis 205. Through this recess, a securing screw 207 is passed which is screwed into the workpiece holder 202.

On the side of the workpiece holder 202 facing the brush 201, a guard plate 209 is provided which extends at right angles to the base thereof. The plate 209 has an aperture 292 formed therein through which a portion of the brush 201 projects to debur the metal sheet 208. The upper part 291 of this guard plate 209, in dependence upon the outline of the brush 201 is set back towards the support plate 206. The support plate 206 is, itself, recessed rectangularly in the region of the brush 201.

Depending upon the method of treatment, and upon the wearing of the brush 201, the latter is displaceable horizontally towards the workpiece holder 202 and adjustable. By inclining the support plate 206 or possibly by repeated up and down pivotal movement, the edge of the metal sheet 208 to be deburred, which is drawn past the recess 292 in the direction of the arrow, and abuts against the guard plate 209, is neatly deburred and radiused.

I claim:

1. In an apparatus for deburring workpieces such as profiles, tubes, metal sheets or the like of the type including a housing and a deburring tool rotatably mounted within the housing about a horizontal axis such that the tool partially projects from the housing, the improvement comprising:

a workpiece holder located in front of said housing for holding said workpiece to be deburred level with and in abutment with said rotatable tool, said holder including a block portion;

workpiece retaining means mounted on said block portion so as to be displaceable upwardly at an oblique angle to the periphery of said tool, said workpiece retaining means including a holder portion; and means for displacing said block portion and said workpiece retaining means into said housing in a direction towards said tool, said means for displacing said block portion and said workpiece retaining means comprising a horizontal bar guide slidable into the housing, said block portion being mounted on said bar guide.

2. An apparatus as defined in claim 1, wherein said block portion is provided with upper and cower faces, said block portion defining a through bore extending obliquely from said lower face to said upper face, a tube member slidably displaceable in said through bore, said holder portion of said workpiece retaining means being mounted on said tube member.

3. An apparatus as defined in claim 2 wherein said block portion carries, on its upper face, lateral guard plates, said guard plates being substantially triangular.

* * * * *